US006892639B2

(12) United States Patent
Compton et al.

(10) Patent No.: US 6,892,639 B2
(45) Date of Patent: May 17, 2005

(54) FLEXOGRAPHIC PRINTING PRESS WITH INTEGRATED DRYER

(75) Inventors: Craig T. Compton, Green Bay, WI (US); Christopher Delwiche, Green Bay, WI (US); Gregory Ginnow, Green Bay, WI (US)

(73) Assignee: Paper Converting Machine Co., Green Bay, WI (US)

( * ) Notice: Subject to any disclaimer, the term of this patent is extended or adjusted under 35 U.S.C. 154(b) by 143 days.

(21) Appl. No.: 09/826,638

(22) Filed: Apr. 5, 2001

(65) Prior Publication Data

US 2002/0144617 A1 Oct. 10, 2002

(51) Int. Cl.[7] ..... B41F 23/04
(52) U.S. Cl. ..... 101/424.1
(58) Field of Search ..... 101/424.1

(56) References Cited

U.S. PATENT DOCUMENTS 4,898,752 A * 2/1990 Cavagna et al. ..... 427/265
4,909,148 A * 3/1990 George ..... 101/178
4,939,992 A 7/1990 Bird
5,009,157 A 4/1991 Rogge et al.
5,370,047 A 12/1994 Compton
5,407,708 A 4/1995 Lovin et al.
5,483,886 A * 1/1996 Hauer ..... 101/181
5,507,229 A 4/1996 Rogge et al.
6,176,184 B1 1/2001 Mudry
6,220,157 B1 * 4/2001 Delwiche et al. ..... 101/178

FOREIGN PATENT DOCUMENTS

DE 3939368 A1 * 6/1991
EP 0 904 936 A2 3/1999
EP 0 904 936 A3 12/1999
JP 61284441 A * 12/1986
JP 01036452 A * 2/1989

* cited by examiner

*Primary Examiner*—Andrew H. Hirshfeld
*Assistant Examiner*—Jill E. Culler

(57) ABSTRACT

A flexographic printing press is provided which is particularly suited for printing thin, elastic webs. The web is imprinted by a plurality of printing decks which are positioned around a central impression cylinder. A between color dryer is located between each pair of adjacent printing decks and one or more additional dryers are located downstream of the last printing deck for drying the web before it leaves the central impression cylinder. The web does not pass any dryers after it leaves the central impression cylinder.

11 Claims, 3 Drawing Sheets

FLEXOGRAPHIC PRINTING PRESS WITH INTEGRATED DRYER

BACKGROUND OF THE INVENTION

This invention relates to a flexographic printing press which includes a central impression cylinder or drum with a plurality of color stations and a dryer system used to dry solvent or water based inks. Each color station includes a plate roll and an anilox roll. The anilox roll transfers ink from an ink fountain to the plate roll. The plate roll carries the print image and imprints the image onto a web which is supported by the central impression cylinder.

Currently, high quality flexographic printing using extensible web materials is done on central impression (CI) presses. The flexographic process offers distinct cost advantages and flexibility compared to other types of printing such as gravure. The advantage of using a CI drum over an in-line flexopress is that the web is stable during the printing process. The stability of the web allows for higher quality printing on a variety of substances including extensible films. An example of an extensible film is 0.001 inch polyethylene. A general trend in the printing industry is to save material cost by using thinner webs or films which are ultimately more extensible. Certain segments of the printing industry also use film that characteristically shrinks when heat is applied. An example of this type of film is Cryovac SSD film.

However, there are limitations to the stability of the web, which affect the overall product being produced. It is important to maintain the stability of the web not only while it passes through the prior stations but also during the time that the web is moving through the machine. Disturbances in the web handling process as the web travels from the unwind, through each machine section, and finally to the rewind lead to print registration errors, printed image or repeat variation, and web distortion.

On modern presses, the ink drying and/or curing process causes the greatest amount of damage to the web. Dryers play a vital role in the printing process. The dryer system on a press is used to extract the carrier, either solvent or water, from the ink that is printed on the web. In the ink formulation, the carrier is mixed with the toner, which gives the ink its color, and is used to transport the toner to the printed surface. The most common dryer system uses hot air, sometimes with the assistance of infrared radiation, which impinges the printed web.

"Between color" dryers are located on the impression cylinder between each color station. The purpose of this type of dryer is to dry the ink to a level that another layer of ink can be printed on top of the previous layer. The advantage of the between color dryer is that the web maintains a controlled temperature due to the impression cylinder. The impression cylinder is normally thermally controlled to one degree Fahrenheit by circulating water through the inner shell of the cylinder. Because the cylinder maintains its temperature, the web, through conduction, will also maintain a stable temperature.

Once the last color is printed on the web, the web leaves the central impression cylinder and enters a dryer section. This section is commonly referenced as the tunnel dryer. While the web is passing through the tunnel dryer, it is supported by a number of the guide or idler rolls.

The tunnel dryer acts like an oven. Its purpose is to evaporate the remaining carrier from the printed web. The problem with the tunnel dryer, once the carrier has been removed, is that the heat of the dryer is absorbed into the web. If too much heat is absorbed into the web, the web temperature will exceed the thermal yield point and start distorting. Extensible films characteristically have low thermal yield temperatures. Also, as a general rule the thinner the film, the lower the yield temperature. These factors are making it more difficult to design and use a tunnel dryer in current flexographic presses.

Another significant issue that results in deformation of the web is caused by the tension imparted on the web as the web travels through the machine. As described previously, the web is supported through the tunnel dryer and between machine sections by idler rolls. In most applications, the web is used to rotate the idler rolls. The web path plays a significant role in the amount of tension required in the system. The longer the web path, the greater the amount of idler roll friction the web needs to overcome or drive, which in turn is proportional to the amount of tension imparted on the web. The extensible films described above can withstand minimal tension before permanent distortion occurs.

SUMMARY OF THE INVENTION

The goal of this invention is to create an economical printing press that will allow the use of thin gauge, highly elastic films in a flexographic printing process. To accomplish this task, the printed ink on the web needs to be dried before the web is removed from the impression cylinder. By maintaining the web on the drum throughout the entire drying process, the web will not be susceptible to the disturbances seen in present machines. A dryer system using advanced dryer technology allows a design that locates all the dryers around the perimeter of the impression cylinder and the removal of the tunnel dryer. The machine design also minimizes the length of web path, which maximizes the ability to use highly extensible films.

DESCRIPTION OF THE DRAWINGS

The invention will be explained in conjunction with illustrative embodiments shown in the accompanying drawing, in which.

DESCRIPTION OF SPECIFIC EMBODIMENT

Figure 1:
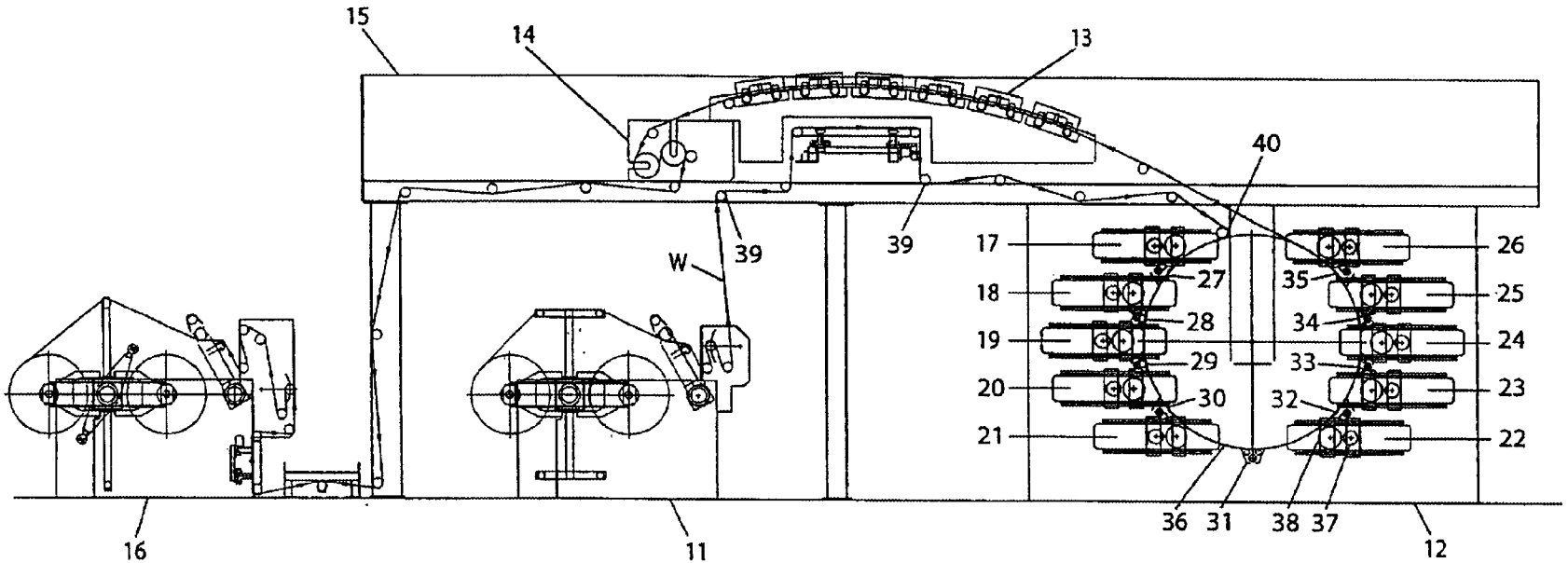
FIG. 1 PRIOR ART
FIG. 1 illustrates a prior art CI flexographic press.

FIG. 1 illustrates a prior art flexographic press which was made by applicants' assignee Paper Converting Machine Company. The sections of this machine, in the sequence of the web path, include an unwind 11, press section 12, tunnel dryer 13, cooling rolls 14, overhead framework 15, and a rewind 16. The press includes ten color decks 17 through 26. Between color dryers 27 through 35 are located around a central impression cylinder 36. Each deck includes an anilox roll 37 and a plate roll 38 for applying ink to a web W that rotates with the central impression cylinder.

The web is unwound from the unwind 11 and passes over idler rolls 39 to the central impression cylinder 36. The web is nipped to the impression cylinder at the nip roll 40 and rotates with the impression cylinder. The web then passes through a tunnel dryer 13 and over a cooling roll 14 before entering the rewind 16. The length of web path for the machine shown in FIG. 1 is approximately 125 feet. The number of idler rolls, which follow the web path, totals forty-three. The length of the machine is 52 feet.

Figure 2:
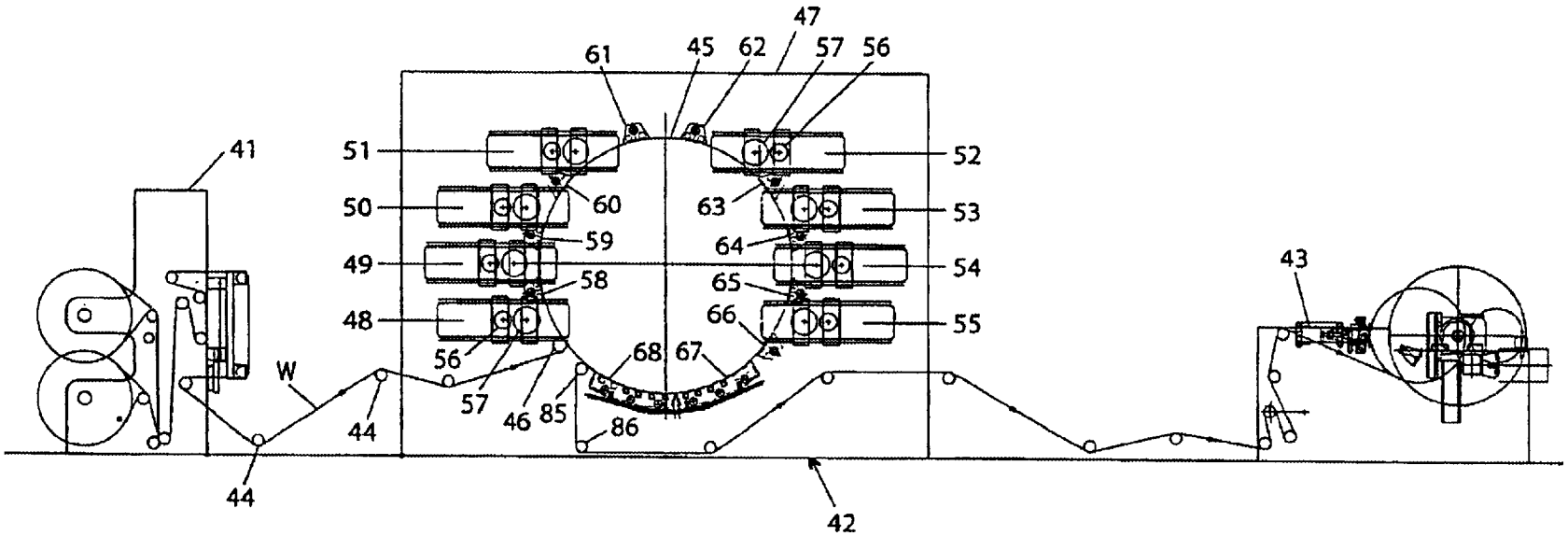
FIG. 2 illustrates a flexographic press formed in accordance with the invention.

FIG. 2 is a side elevation view of a machine designed in accordance with the invention. Because of the efficient design only an unwind 41, press assembly 42, and a rewind 43 are required to fulfill the same requirements as the machine described as prior art.

As in the prior art example, the web W is unwound from the unwind 41 and travels in a downstream direction over idler rolls 44 to a central impression cylinder 45 at the nip roll 46. The nip roll insures that the web rotates with central impression cylinder 45 and forms an upstream entry point at which the web contacts the central impression cylinder.

The central impression cylinder 45 is rotatably supported by framework 47. The other components of the press section are also supported by the framework. The framework used in the invention is quite similar to the prior art example. The difference being the bottom deck on each side of the cylinder has been replaced with space for additional dryer modules. Consequently, the machine described in this invention is capable of printing eight colors.

The press assembly 42 includes the framework 47 and the components which are supported by the framework, including the central impression cylinder 45, the printing decks, and the dryers.

Another striking difference between the prior art example and the invention is that the web path is oriented toward the bottom of the machine. The web path was originally designed to feed from the bottom for ease of thread up and access to dryer modules. However, the design also allows for the more conventional overhead infeed to the press section. In that case, the web path would be slightly longer, and the first printing station would be near the top of the press section.

The press illustrated in FIG. 2 contains eight color decks or printing decks 48 through 55. Deck 48 is the most upstream deck, and deck 55 is the most downstream deck. Each deck is identical to the next. Each deck contains an anilox cylinder 56 and a plate cylinder 57 for applying ink to a web W as it rotates with the central impression cylinder.

Similar to the prior art, dryer modules 58 through 65 are located between adjacent color stations. Two between color modules 61 and 62 are located near the top of the press section between the fourth and fifth decks 51 and 52. The additional dryer module is used to supplement the drying of the first four colors. Because of space requirements and similarity of parts, a "between color" dryer 66 is also placed after the last or most downstream color deck 55.

The between color dryers are advantageously formed in accordance with U.S. Pat. No. 6,176,184. As described in the patent, each dryer includes two nozzle plenums which are provided with orifices. The orifices are angled toward the sides of the central impression cylinder to help spread the web on the cylinder. A heat source heats air which is supplied to the nozzle plenums.

Prior to the web leaving the central impression cylinder, the web passes under two enhanced dryer modules 67 and 68. The dryers 67 and 68 are also advantageously formed in accordance with U.S. Pat. No. 6,176,184. Each module contains six nozzle plenums, or the equivalent of three "between color" dryer modules, and three heaters, one for each pair of plenums. The nozzles are straight rather than angled.

Each pair of nozzle plenums is heated by its own heat source, which is independently controlled. The independent control allows the nozzle temperature to be profiled or compensated to the amount of drying required for the web. Anyone skilled in the art of printing is capable of adjusting each module so that the web maintains its characteristics.

The last pair of nozzle plenums on the downstream dryer 68 are advantageously not heated so that the nozzles impinge cold air on the web rather than heated air. The cold air will act to cool the web to insure web stability as it exits the press section. The compressed air which is supplied to the plenums as described in U.S. Pat. No. 6,176,184 undergoes adiabatic expansion as it passes through the plenums, and the temperature of the unheated air will ordinarily be less than room temperature.

This machine advantageously, but not necessarily, includes state of the art dryer technology which is described in U.S. Pat. No. 6,176,184. With this dryer system, all the drying is accomplished while the web W is still riding on the surface of the impression cylinder. By drying the web on the impression cylinder, the invention's primary goal of maintaining web stability is satisfied. A more conventional, less efficient, dryer system could be used in this design. However, the speed of the machine, the amount of colors that could be printed, and the size of the drum would all be adversely effected.

Figure 3:
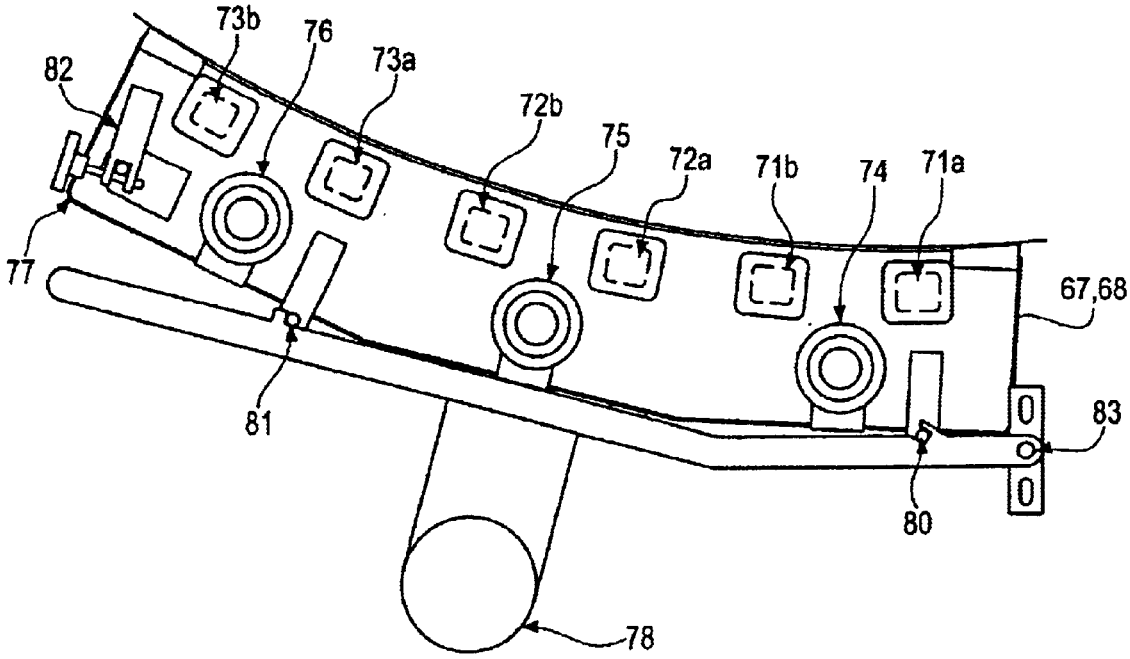
FIG. 3 is an end view of one of the downstream dryers.

FIG. 3 illustrates one specific embodiment of the dryer modules 67 and 68. Three pairs of nozzle plenums 71*a* and 71*b*, 72*a* and 72*b*, and 73*a* and 73*b* are supplied with heated air by air plenums 74, 75, and 76, respectively. The plenums are enclosed with an outer wall 77 which confines the solvent-laden air that is exhausted from the web. Exhaust port 78 exhausts air from the dryer module.

A lift arm 80 positions the dryer module relative to the central impression cylinder. The lift arm is attached to the dryer module by bracket and pin assemblies 81. A bracket and pin assembly 82 holds the dryer module in position relative to the central impression cylinder. The outer wall 77 is hinged at 83 so that the wall can be easily opened to access the plenums for removal or cleaning.

As the web is removed from the impression cylinder, the web passes two idler rolls 85 and 86. The first roll 85 defines the downstream exit point between the web and the central impression cylinder. The design allows these idler rolls to be either standard rolls or air turn bars or modules. The air turn modules are well known in the art and are used in circumstances where additional web cooling is necessary to maintain print quality or when special film is used that would require unique downstream drying requirements. The air turn modules provide a layer of air between the web and the modules.

Finally, the web travels downstream from the remaining idler rolls in the press section to the rewind section 43. Although it is not depicted in FIG. 2, any specialized units such as web viewers, camera systems, or web handling equipment would be inserted in the area between the press section and the rewind section.

Another goal of this invention is to minimize the length of the web path through the machine. In this design, only twenty-four idler rolls 44 are needed to support the web in the embodiment illustrated in FIG. 2. This design has accomplished the goal of reducing the amount of idler rolls to approximately half the number of the prior art. The total web length has also been reduced by a margin of 40%. For a highly extensible web, the consequence of the design results in a machine that has the ability to run at low tensions. For an extensible film, the higher the web tension, the more likely that the film will yield.

Some of the benefits to this system are the following:

1. Ability to print highly extensible or heat sensitive films.
2. Short web path between print sections minimizes web disturbances, which play a key role in the overall quality of the printed product.

3. Machine design obtains a low height profile for convenient operator access and increased level of safety. It also allows the machine to fit into plants with low ceiling.
4. High quality web handling based on simplified design. The web is continuously supported on the central impression cylinder during the entire print and drying process.
5. Machine cost reduction due to the elimination of the tunnel dryer and overhead sections.
6. Simplified web path allows for easier thread-up.
7. Process control without affecting overall drying.

The system can compensate for web stretch or shrinkage by maximizing individual dryer modules.

While in the foregoing specification a detailed description of specific embodiments of the invention was set forth for the purpose of illustration, it will be understood that many of the details hereingiven can be varied considerably by those skilled in the art without departing from the spirit and scope of the invention.

We claim:

1. A flexographic printing press for printing a web with a solvent based or water based ink comprising:

a central impression cylinder having an outside surface adapted to support a web during printing, an unwind apparatus adapted to unwind a web to be printed on the central impression cylinder, means for guiding a web between the unwind apparatus and the central impression cylinder and providing an upstream entry point to the central impression cylinder, a rewind apparatus adapted to rewind a printed web, means for guiding a web between the central impression cylinder and the rewind apparatus and providing a downstream exit point from the central impression cylinder, the unwind apparatus, central impression cylinder, and rewind apparatus defining a path of web travel from an upstream direction to a downstream direction, a plurality of printing decks positioned around the outside surface of the central impression cylinder, including an upstream printing deck adjacent said upstream entry point and a downstream printing deck adjacent said downstream exit point, each of the printing decks including a plate cylinder for applying solvent based or water based ink to a web on the central impression cylinder.

at least one between color dryer positioned between each pair of adjacent printing decks, and a downstream dryer positioned between the downstream printing deck and the downstream exit point for drying a web on the central impression cylinder before the downstream exit point, no dryer being located between said exit point from the central impression cylinder and said rewind apparatus.

2. The press of claim 1 in which said means for guiding a web between the central impression cylinder and the rewind apparatus includes an air turning bar.

3. The press of claim 2, in which said air turning bar is adjacent said exit point from the central impression cylinder.

4. The press of claim 1 in which said downstream dryer includes a plurality of nozzle plenums, a plurality of heat sources, and separate control means for each of the heat sources.

5. The press of claim 1 including a second downstream dryer positioned between the downstream printing deck and the downstream exit point for drying a web on the central impression cylinder before the downstream exit point.

6. The press of claim 5 in which each of said downstream dryers includes a plurality of nozzles, a plurality of heat sources, and separate control means for controlling each of the heat sources.

7. The press of claim 1 in which the downstream dryer includes a nozzle plenum for directing air against a web supported by the central impression cylinder and means for supplying unheated air to the nozzle plenum whereby cold air is directed by the nozzle plenum against the web.

8. The press of claim 1 in which each of the between color dryers and the downstream dryer includes a heat source for heating air which is directed by the dryer to a web which is supported by the central impression cylinder.

9. The press of claim 8 including a second downstream dryer positioned between the downstream printing deck and the downstream exit point for drying a web on the central impression cylinder before the downstream exit point, the downstream dryer including a nozzle plenum for directing air against a web supported by the central impression cylinder and means for supplying unheated air to the nozzle plenum whereby cold air is directed by the nozzle plenum against the web.

10. The press of claim 1 in which the press includes a top and a bottom and the upstream entry point to the central impression cylinder is adjacent the bottom of the press and the downstream exit point from the central impression cylinder is adjacent the bottom of the press.

11. The press of claim 10 including a nip roll mounted adjacent the upstream entry point to the central impression cylinder and a roll mounted adjacent the downstream exit point from the central impression cylinder.

* * * * *